US010399144B2

(12) United States Patent
Cook, III

(10) Patent No.: US 10,399,144 B2
(45) Date of Patent: Sep. 3, 2019

(54) SURFACE COATING FOR METAL MATRIX COMPOSITES

(71) Applicant: Halliburton Energy Services, Inc., Houston, TX (US)

(72) Inventor: Grant O. Cook, III, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 777 days.

(21) Appl. No.: 14/900,671

(22) PCT Filed: Mar. 2, 2015

(86) PCT No.: PCT/US2015/018323
§ 371 (c)(1),
(2) Date: Dec. 22, 2015

(87) PCT Pub. No.: WO2016/140646
PCT Pub. Date: Sep. 9, 2016

(65) Prior Publication Data

US 2016/0375486 A1 Dec. 29, 2016

(51) Int. Cl.
*B22D 27/18* (2006.01)
*B22F 7/06* (2006.01)
(Continued)

(52) U.S. Cl.
CPC ..... *B22D 27/18* (2013.01); *B22D 19/02* (2013.01); *B22D 19/06* (2013.01); *B22F 7/06* (2013.01);
(Continued)

(58) Field of Classification Search
CPC ..... B22D 27/18; B22D 10/02; B22D 19/06; B22F 7/06; B22F 2003/026; B22F 5/001;
(Continued)

(56) References Cited

U.S. PATENT DOCUMENTS 5,509,490 A 4/1996 Paske et al.
5,514,422 A 5/1996 McCune
(Continued)

FOREIGN PATENT DOCUMENTS

CA 2260176 A1 7/1999
EP 441262 A1 8/1991
(Continued)

OTHER PUBLICATIONS

International Search Report and Written Opinion for PCT/US2015/018323 dated Nov. 10, 2015.
(Continued)

*Primary Examiner* — Yong-Suk Ro
(74) *Attorney, Agent, or Firm* — Alan Bryson; C. Tumey Law Group PLLC

(57) ABSTRACT

A method of fabricating a metal matrix composite (MMC) tool includes coating at least a portion of an interior of a mold assembly with one or more layers of a material coating, where the mold assembly defines at least a portion of an infiltration chamber. Reinforcing materials are deposited into the infiltration chamber, and infiltrated with a binder material. One or more layers of the material coating may then be reacted with the binder material to form an outer shell on selected outer surfaces of the MMC tool.

23 Claims, 4 Drawing Sheets

(51) Int. Cl.

| | |
|---|---|
| ***E21B 10/42*** | (2006.01) |
| ***B22D 19/02*** | (2006.01) |
| ***B22D 19/06*** | (2006.01) |
| ***E21B 10/08*** | (2006.01) |
| ***E21B 10/26*** | (2006.01) |
| ***E21B 10/32*** | (2006.01) |
| ***E21B 10/567*** | (2006.01) |
| ***E21B 10/60*** | (2006.01) |
| ***E21B 17/10*** | (2006.01) |
| ***E21B 31/20*** | (2006.01) |
| ***E21B 47/12*** | (2012.01) |
| ***E21B 49/06*** | (2006.01) |
| *B22F 3/02* | (2006.01) |
| *B22F 5/00* | (2006.01) |

(52) U.S. Cl.
CPC ..... *E21B 10/08* (2013.01); *E21B 10/26* (2013.01); *E21B 10/32* (2013.01); *E21B 10/42* (2013.01); *E21B 10/567* (2013.01); *E21B 10/60* (2013.01); *E21B 17/1078* (2013.01); *E21B 31/20* (2013.01); *E21B 47/12* (2013.01); *E21B 49/06* (2013.01); *B22F 2003/026* (2013.01); *B22F 2005/001* (2013.01); *B22F 2007/066* (2013.01)

(58) Field of Classification Search
CPC .... B22F 2007/066; E21B 10/08; E21B 10/26; E21B 10/32; E21B 10/42; E21B 10/567; E21B 10/60; E21B 17/1078; E21B 31/20; E21B 47/12; E21B 49/06
See application file for complete search history.

(56) References Cited

U.S. PATENT DOCUMENTS

| | | | |
|---|---|---|---|
| 5,535,838 | A | 7/1996 | Keshavan et al. |
| 5,706,999 | A | 1/1998 | Lim et al. |
| 5,944,128 | A | 8/1999 | Truax et al. |
| 6,517,953 | B1 | 2/2003 | Schultz et al. |
| 6,651,756 | B1 | 11/2003 | Costo, Jr. et al. |
| 6,705,385 | B2 | 3/2004 | Ray et al. |
| 6,799,627 | B2 | 10/2004 | Ray et al. |
| 6,955,233 | B2 | 10/2005 | Crowe et al. |
| 6,986,381 | B2 | 1/2006 | Ray et al. |
| 7,828,089 | B2 | 11/2010 | Buske et al. |
| 7,968,184 | B2 | 6/2011 | Humphreys et al. |
| 8,021,721 | B2 | 9/2011 | Griffo |
| 8,746,375 | B2 | 6/2014 | Hendrik et al. |
| 2004/0118609 | A1 | 6/2004 | Dennis |
| 2006/0042837 | A1 | 3/2006 | Bandi |
| 2008/0127781 | A1 | 6/2008 | Ladi et al. |
| 2008/0164070 | A1 | 7/2008 | Keshavan et al. |
| 2008/0166070 | A1 | 7/2008 | Kariathungal et al. |
| 2011/0042145 | A1 | 2/2011 | Xia et al. |
| 2011/0162751 | A1 | 7/2011 | Fitzgerald et al. |
| 2013/0004881 | A1 | 1/2013 | Shaigan et al. |

FOREIGN PATENT DOCUMENTS

| | | | |
|---|---|---|---|
| EP | 753109 | A1 | 1/1997 |
| EP | 930949 | A1 | 7/1999 |
| EP | 1297195 | A1 | 4/2003 |
| EP | 2373867 | A2 | 10/2011 |
| JP | H09176702 | A | 7/1997 |
| WO | 9527859 | A1 | 10/1995 |
| WO | 9813159 | A1 | 4/1998 |
| WO | 01088219 | A1 | 11/2001 |
| WO | 2010078182 | A2 | 7/2010 |
| WO | 2013016641 | A2 | 1/2013 |
| WO | 2014062348 | A1 | 4/2014 |
| WO | 2014100608 | A1 | 6/2014 |

OTHER PUBLICATIONS

Office Action for Chinese Application No. 201580074562.3 dated Apr. 2, 2019.

SURFACE COATING FOR METAL MATRIX COMPOSITES

BACKGROUND

A wide variety of tools are commonly used in the oil and gas industry for forming wellbores, in completing wellbores that have been drilled, and in producing hydrocarbons such as oil and gas from completed wells. Examples of such tools include cutting tools, such as drill bits, reamers, stabilizers, and coring bits; drilling tools, such as rotary steerable devices and mud motors; and other downhole tools, such as window mills, packers, tool joints, and other wear-prone tools. These tools, and several other types of tools outside the realm of the oil and gas industry, are often formed as metal matrix composites (MMCs), and referred to herein as "MMC tools."

An MMC tool is typically manufactured by placing loose powder reinforcing material into a mold and infiltrating the powder material with a binder material, such as a metallic alloy. The various features of the resulting MMC tool may be provided by shaping the mold cavity and/or by positioning temporary displacement materials within interior portions of the mold cavity. A quantity of the reinforcement material may then be placed within the mold cavity with a quantity of the binder material. The mold is then placed within a furnace and the temperature of the mold is increased to a desired temperature to allow the binder (e.g., metallic alloy) to liquefy and infiltrate the matrix reinforcement material.

MMC tools are generally erosion-resistant and exhibit high impact strength. The outer surfaces of MMC tools are commonly required to operate in extreme conditions. As a result, it may prove advantageous to customize the material properties of the outer surfaces of MMC tools to extend the operating life of a given MMC tool.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates to tool manufacturing and, more particularly, to metal matrix composite tools having a custom coating or surface preparation placed thereon during the infiltration process.

Embodiments described herein result in a customized surface coating or outer shell on metal matrix composite tools, either completely or in select locations, thereby resulting in surface properties that are different than those of bulk metal matrix composite materials. The outer shell is created by coating selected inner surfaces of a mold assembly with a material coating, where the mold assembly is used to fabricate a given metal matrix composite tool. During the manufacturing process, which includes infiltrating reinforcement materials with a binder material to form the given metal matrix composite tool, the binder material may react with the coated material in-situ and thereby result in a metallic, intermetallic, or ceramic outer shell disposed on selected outer surfaces of the given metal matrix composite tool. These outer shells may prove advantageous in altering the surface properties of the given metal matrix composite tool, such as by increasing wear resistance, erosion resistance, abrasion resistance, stiffness (elastic modulus), hardness (i.e., resistance to plastic deformation), yield strength, ultimate tensile strength, fatigue life, lubricity (i.e., reduced friction), hydrophobicity, anti-balling characteristics, and decreasing surface roughness and surface energy.

Embodiments of the present disclosure are applicable to any tool or device formed as a metal matrix composite (MMC). Such tools or devices, referred to herein as "MMC tools," may or may not be used in the oil and gas industry. For purposes of explanation and description only, the following description is related to MMC tools used in the oil and gas industry, such as drill bits, but it will be appreciated that the principles of the present disclosure are equally applicable to any type of MMC used in any industry or field, such as armor plating, automotive components (e.g., sleeves, cylinder liners, driveshafts, exhaust valves, brake rotors), bicycle frames, brake fins, aerospace components (e.g., landing-gear components, structural tubes, struts, shafts, links, ducts, waveguides, guide vanes, rotor-blade sleeves, ventral fins, actuators, exhaust structures, cases, frames), and turbopump components, without departing from the scope of the disclosure.

Figure 1:
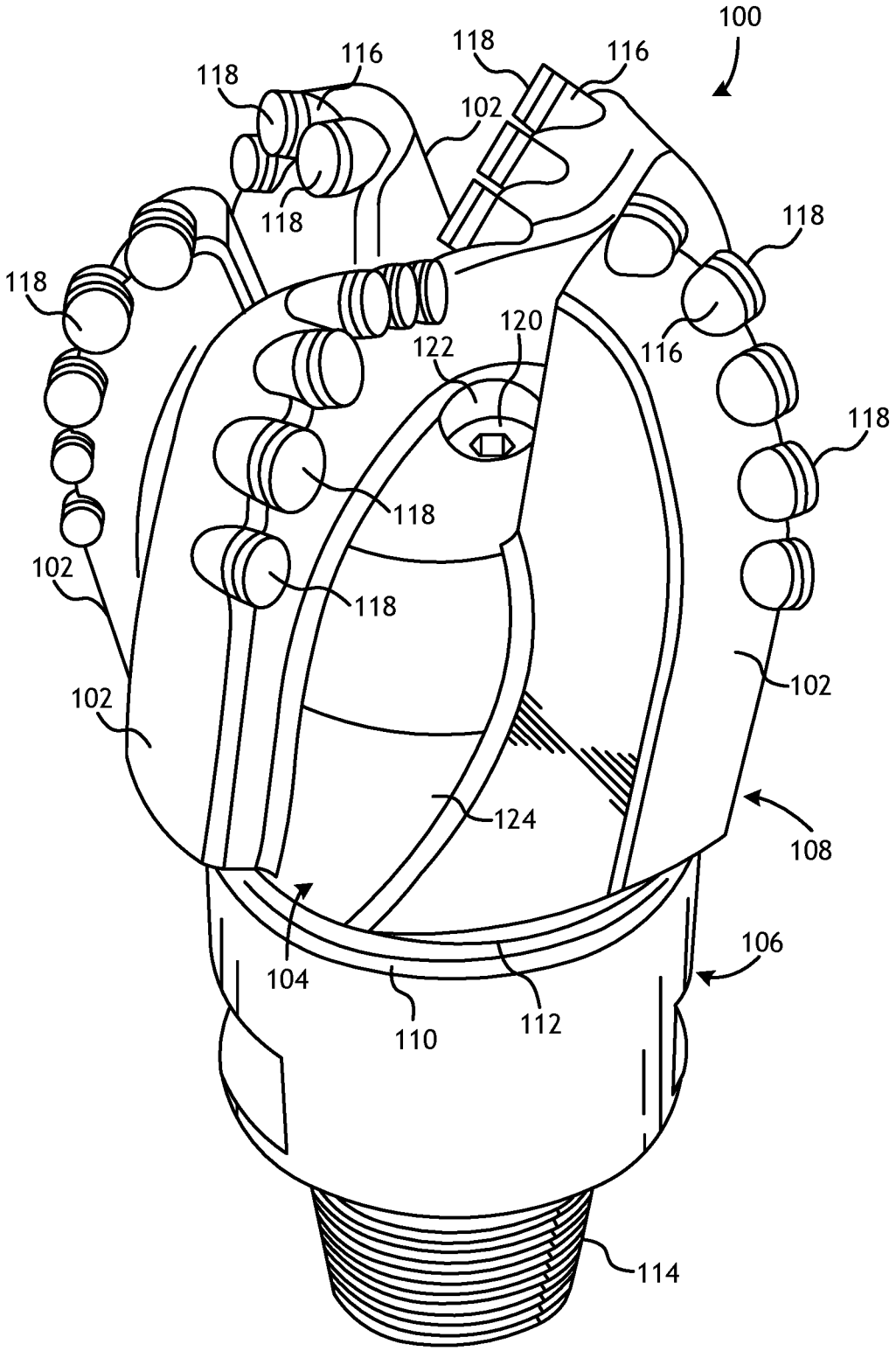
FIG. 1 is a perspective view of an exemplary drill bit that may be fabricated in accordance with the principles of the present disclosure.

Referring to FIG. 1, illustrated is a perspective view of an example MMC tool 100 that may be fabricated in accordance with the principles of the present disclosure. The MMC tool 100 is generally depicted in FIG. 1 as a fixed-cutter drill bit that may be used in the oil and gas industry to drill wellbores. Accordingly, the MMC tool 100 will be referred to herein as the "drill bit 100," but, as indicated above, the drill bit 100 may alternatively be replaced with any type of MMC tool or device used in the oil and gas industry or any other industry, without departing from the scope of the disclosure.

Suitable MMC tools used in the oil and gas industry that may be manufactured in accordance with the present disclosure include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, wash-over tools, rotors, stators and/or housings for downhole drilling motors, blades and housings for downhole turbines, and other downhole tools having complex configurations and/or asymmetric geometries associated with forming a wellbore.

As illustrated in FIG. 1, the drill bit 100 may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple recesses or pockets 116 are formed. Cutting elements 118 may be fixedly installed within each pocket 116. This can be done, for example, by brazing each cutting element 118 into a corresponding pocket 116. As the drill bit 100 is rotated in use, the cutting elements 118 engage the rock and underlying earthen materials, to dig, scrape or grind away the material of the formation being penetrated.

During drilling operations, drilling fluid or "mud" is pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each adjacent pair of cutter blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

Figure 2:
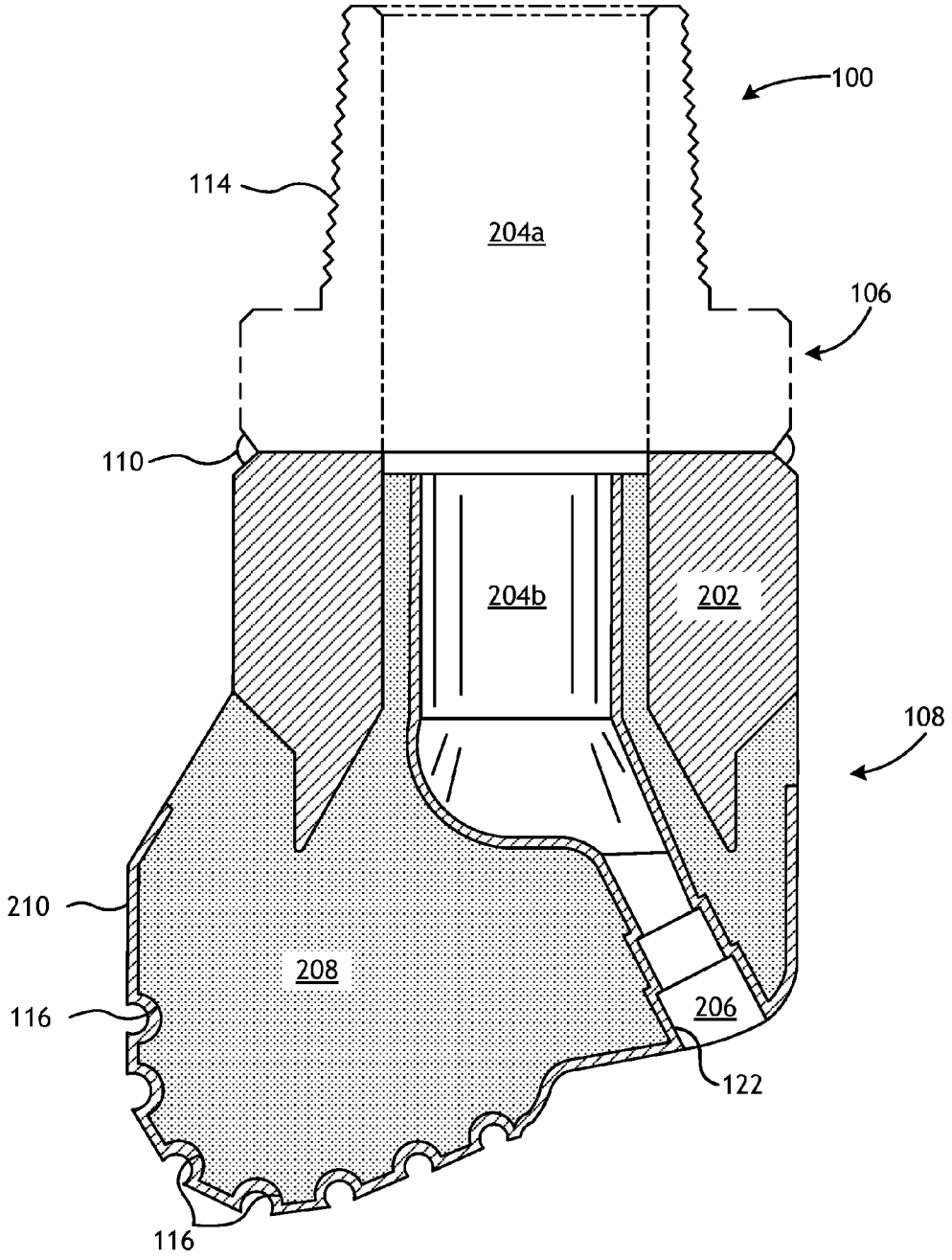
FIG. 2 is a cross-sectional view of the drill bit of FIG. 1.

FIG. 2 is a cross-sectional side view of the drill bit 100 of FIG. 1. Similar numerals from FIG. 1 that are used in FIG. 2 refer to similar components that are not described again. As illustrated, the shank 106 may be securely attached to a metal blank (or mandrel) 202 at the weld 110 and the metal blank 202 extends into the bit body 108. The shank 106 and the metal blank 202 are generally cylindrical structures that define corresponding fluid cavities 204*a* and 204*b*, respectively, in fluid communication with each other. The fluid cavity 204*b* of the metal blank 202 may further extend longitudinally into the bit body 108. At least one flow passageway 206 (one shown) may extend from the fluid cavity 204*b* to exterior portions of the bit body 108. The nozzle openings 122 may be defined at the ends of the flow passageways 206 at the exterior portions of the bit body 108. The pockets 116 are formed in the bit body 108 and are shaped or otherwise configured to receive the cutting elements 118 (FIG. 1). The bit body 108 may comprise a reinforced composite material 208 and, according to embodiments described herein, an outer shell 210 may be disposed on selected outer and/or inner surfaces of the bit body 108.

Figure 3:
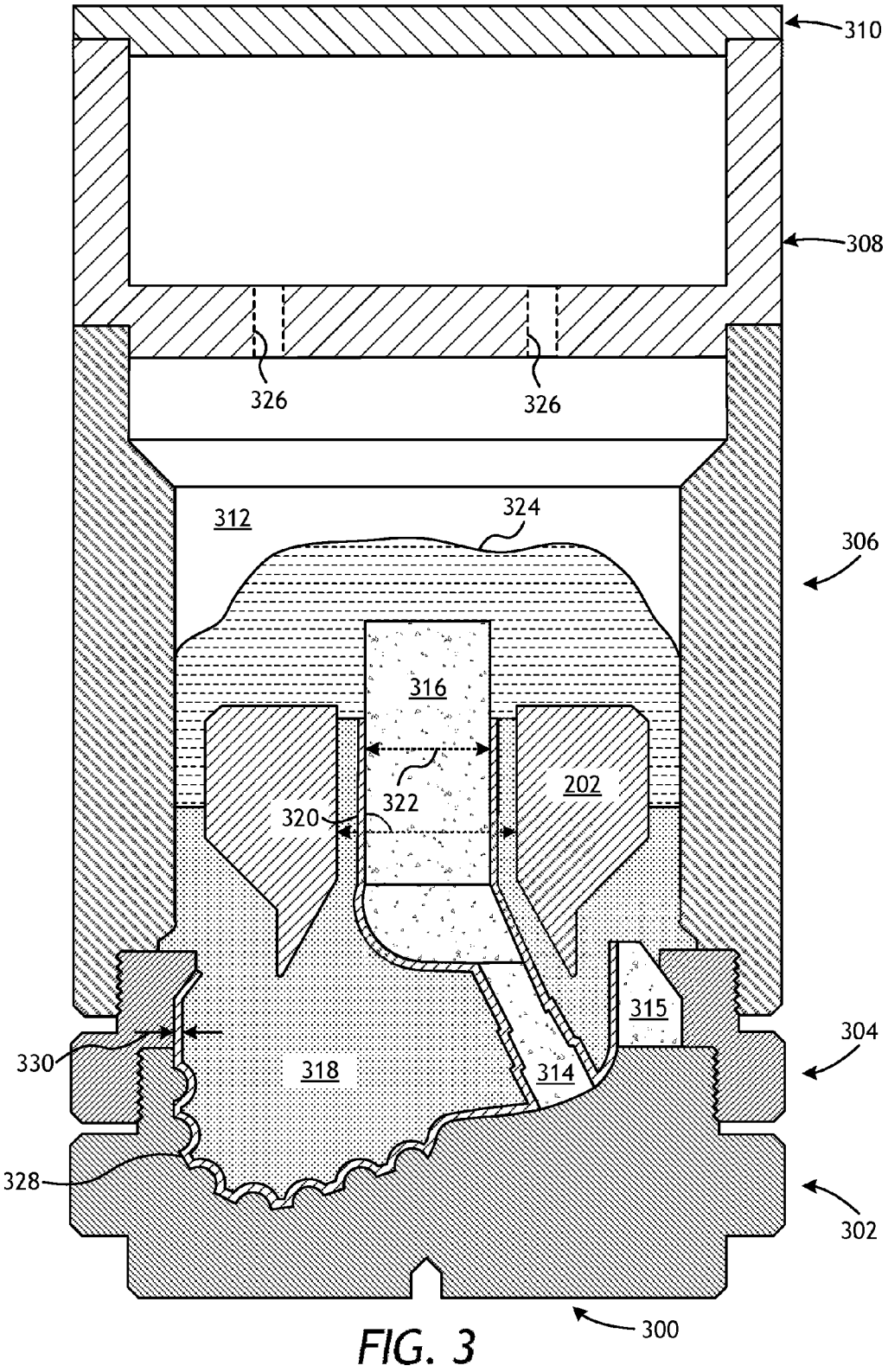
FIG. 3 is a cross-sectional side view of an exemplary mold assembly for use in forming the drill bit of FIG. 1.

FIG. 3 is a cross-sectional side view of a mold assembly 300 that may be used to form the drill bit 100 of FIGS. 1 and 2. While the mold assembly 300 is shown and discussed as being used to help fabricate the drill bit 100, those skilled in the art will readily appreciate that different configurations of the mold assembly 300 may be used to help fabricate any of the MMC tools mentioned above, without departing from the scope of the disclosure. As illustrated, the mold assembly 300 may include several components such as a mold 302, a gauge ring 304, and a funnel 306. In some embodiments, the funnel 306 may be operatively coupled to the mold 302 via the gauge ring 304, such as by corresponding threaded engagements, as illustrated. In other embodiments, the gauge ring 304 may be omitted from the mold assembly 300 and the funnel 306 may instead be operatively coupled directly to the mold 302, such as via a corresponding threaded engagement, without departing from the scope of the disclosure.

In some embodiments, as illustrated, the mold assembly 300 may further include a binder bowl 308 and a cap 310 placed above the funnel 306. The mold 302, the gauge ring 304, the funnel 306, the binder bowl 308, and the cap 310 may each be made of or otherwise comprise graphite or alumina ($Al_2O_3$), for example, or other suitable materials. An infiltration chamber 312 may be defined or otherwise provided within the mold assembly 300. Various techniques may be used to manufacture the mold assembly 300 and its components including, but not limited to, machining graphite (or alumina) blanks to produce the various components and thereby define the infiltration chamber 312 to exhibit a negative or reverse profile of desired exterior features of the drill bit 100 (FIGS. 1 and 2).

In embodiments where the mold assembly 300 is made of graphite, the graphite may be anisotropic. In such embodiments, the anisotropic graphite may exhibit a minimum flexural strength of about 2 ksi, a minimum compressive strength of about 5 ksi, a minimum density of about 1.6 $g/cm^3$, and a maximum porosity of about 20%.

Materials, such as consolidated sand or graphite, may be positioned within the mold assembly 300 at desired locations to form various features of the drill bit 100 (FIGS. 1 and 2). For example, one or more nozzle displacements or legs 314 (one shown) may be positioned to correspond with desired locations and configurations of the flow passageways 206 (FIG. 2) and their respective nozzle openings 122 (FIGS. 1 and 2). One or more junk slot displacements 315 may also be positioned within the mold assembly 300 to correspond with the junk slots 124 (FIG. 1). Moreover, a cylindrically-shaped consolidated central displacement 316 may be placed on the legs 314. The number of legs 314 extending from the central displacement 316 will depend upon the desired number of flow passageways and corresponding nozzle openings 122 in the drill bit 100. Further, cutter-pocket displacements (shown as part of mold 302 in FIG. 3) may be placed in the mold 302 to form cutter pockets 116.

After the desired materials, including the central displacement 316 and the legs 314, have been installed within the mold assembly 300, reinforcement materials 318 may then be placed within or otherwise introduced into the mold assembly 300. The reinforcement materials 318 may be in powder form and include reinforcing particles. Suitable reinforcing particles include, but are not limited to, particles of metals, metal alloys, superalloys, intermetallics, borides, carbides, nitrides, oxides, ceramics, diamonds, and the like, or any combination thereof. More particularly, examples of reinforcing particles suitable for use in conjunction with the embodiments described herein may include particles that include, but are not limited to, tungsten, molybdenum, niobium, tantalum, rhenium, iridium, ruthenium, beryllium, titanium, chromium, rhodium, iron, cobalt, nickel, nitrides, silicon nitrides, boron nitrides, cubic boron nitrides, natural diamonds, synthetic diamonds, cemented carbide, spherical carbides, low-alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, cobalt alloys, chromium alloys, HASTELLOY® alloys (i.e., nickel-chromium containing alloys, available from Haynes International), INCONEL® alloys (i.e., austenitic nickel-chromium containing superalloys available from Special Metals Corporation), WASPALOYS® (i.e., austenitic nickel-based superalloys), RENE® alloys (i.e., nickel-chromium containing alloys available from Altemp Alloys, Inc.), HAYNES@ alloys (i.e., nickel-chromium containing superalloys available from Haynes International), INCOLOY® alloys (i.e., iron-nickel containing superalloys available from Mega Mex), MP98T (i.e., a nickel-copper-chromium superalloy available from SPS Technologies), TMS alloys, CMSX® alloys (i.e., nickel-based superalloys available from C-M Group), cobalt alloy 6B (i.e., cobalt-based superalloy available from HPA), N-155 alloys, any mixture thereof, and any combination thereof. In some embodiments, the reinforcing particles may be coated. For example, by way of non-limiting example, the reinforcing particles may comprise diamond coated with titanium.

The reinforcing particles described herein may have a diameter ranging from a lower limit of 1 micron, 10 microns, 50 microns, or 100 microns to an upper limit of 1000 microns, 800 microns, 500 microns, 400 microns, or 200 microns, wherein the diameter of the reinforcing particles may range from any lower limit to any upper limit and encompasses any subset therebetween.

The metal blank 202 may be supported at least partially by the reinforcement materials 318 within the infiltration chamber 312. More particularly, after a sufficient volume of the reinforcement materials 318 has been added to the mold assembly 300, the metal blank 202 may then be placed within mold assembly 300. The metal blank 202 may include an inside diameter 320 that is greater than an outside diameter 322 of the central displacement 316, and various fixtures (not expressly shown) may be used to position the metal blank 202 within the mold assembly 300 at a desired location. The reinforcement materials 318 may then be filled to a desired level within the infiltration chamber 312.

Binder material 324 may then be placed on top of the reinforcement materials 318, the metal blank 202, and the core 316. Suitable binder materials 324 include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Non-limiting examples of the binder material 324 may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. Examples of commercially-available binder materials 324 include, but are not limited to, VIRGIN™ Binder 453D (copper-manganese-nickel-zinc, available from Belmont Metals, Inc.); copper-tin-manganese-nickel and copper-tin-manganese-nickel-iron grades 516, 519, 523, 512, 518, and 520 available from ATI Firth Sterling; and any combination thereof.

In some embodiments, the binder material 324 may be covered with a flux layer (not expressly shown). The amount of binder material 324 (and optional flux material) added to the infiltration chamber 312 should be at least enough to infiltrate the reinforcement materials 318 during the infiltration process. In some instances, some or all of the binder material 324 may be placed in the binder bowl 308, which may be used to distribute the binder material 324 into the infiltration chamber 312 via various conduits 326 that extend therethrough. The cap 310 (if used) may then be placed over the mold assembly 300. The mold assembly 300 and the materials disposed therein may then be preheated and then placed in a furnace (not shown) at atmospheric conditions. When the furnace temperature reaches the melting point of the binder material 324, the binder material 324 will liquefy and proceed to infiltrate the reinforcement materials 318 and form the reinforced composite material 208 (FIG. 2). After a predetermined amount of time allotted for the liquefied binder material 324 to infiltrate the reinforcement materials 318, the mold assembly 300 may then be removed from the furnace and cooled at a controlled rate. Once cooled, the mold assembly 300 may be broken away to expose the bit body 108 and subsequent machining and processing according to well-known techniques may be undertaken to finish the drill bit 100 (FIG. 1).

According to embodiments of the present disclosure, and with continued reference to FIGS. 1-3, the drill bit 100 may further comprise a custom surface preparation and/or coating (e.g., the outer shell 210 of FIG. 2) deposited on all or a portion of the outer surfaces of the bit body 108. To accomplish this, all or a portion of the interior of the mold assembly 300 may be coated with a material coating 328 prior to the infiltration process, and thereby providing a coated mold assembly 300. The material coating 328 may be deposited on the inner walls of some or all of the mold 302 and the gauge ring 304 (if used), i.e., the walls facing the infiltration chamber 312 and generally the portions of the mold assembly 300 where the bit body 108 is to be formed and where the external bit surfaces will not be machined away during post-processing. The material coating 328 may also be deposited on the central displacement 316, the legs 314, and the junk-slot displacements 315. The central displacement 316, the legs 314, the junk-slot displacements 315, the reinforcing materials 318, the metal blank 202, and the binder material 324 may then be placed in the infiltration chamber 312 and otherwise prepared for the infiltration process at atmospheric conditions. During the infiltration process, the material coating 328 may be designed to react in-situ with the binder material 324 that infiltrates the reinforcing materials 318. The result of the in-situ reaction between the material coating 328 and the binder material 324 may be the formation of a metallic, intermetallic, or ceramic outer shell 210 (FIG. 2) on selected outer surfaces of the resulting drill bit 100.

The material coating 328 may comprise one or more layers of materials or material compositions that serve to modify the resulting surface properties of the bit body 108 following infiltration. For instance, depending on the number of layers and/or the type and number of materials used, the material coating 328 may alter surface properties of the bit body 108 such as, but not limited to, wear resistance, erosion resistance, abrasion resistance, stiffness (elastic modulus), hardness (i.e., resistance to plastic deformation), yield strength, ultimate tensile strength, fatigue life, lubricity (i.e., reduced friction), hydrophobicity, anti-balling characteristics, surface roughness, and surface energy. Suitable materials for the material coating 328 include, but are not limited to, transition metals (e.g., iridium, rhenium, ruthenium, tungsten, molybdenum, hafnium, chromium, manganese, rhodium, iron, cobalt, titanium, niobium, osmium, palladium, platinum, zirconium, nickel, copper, scandium, tantalum, vanadium, yttrium), post-transition metals (e.g., aluminum and tin), semi-metals (e.g., boron and silicon), alkaline-earth metals (e.g., beryllium and magnesium), lanthanides (e.g., lanthanum and ytterbium), non-metals (e.g., carbon, nitrogen, and oxygen), any alloy thereof, and the like.

Using alloys that contain chromium, carbon, molybdenum, manganese, nickel, cobalt, tungsten, niobium, tantalum, vanadium, silicon, copper, and iron for the material coating 328 may produce a wear-resistant, erosion-resistant, abrasion-resistant, or hard outer shell 210 on the bit body 108 during the infiltration process. Using iridium, rhenium, ruthenium, tungsten, molybdenum, beryllium, chromium, rhodium, iron, cobalt, nickel, and alloys thereof for the material coating 328 may prove advantageous since such metals exhibit a relatively high modulus of elasticity, and may therefore produce a stiff, outer shell 210 on the bit body 108 during the infiltration process. For example, alloying nickel with vanadium, chromium, molybdenum, tantalum, tungsten, rhenium, osmium, or iridium increases the elastic modulus of the resulting alloy.

The formation of ceramic materials (e.g., carbides, borides, nitrides, and oxides) in the outer shell 210 may produce beneficial changes in any of the desired properties mentioned previously. The in-situ formation of carbides, borides, nitrides, and oxides may be achieved by including carbon, boron, nitrogen, and oxygen in the material coating 328. In particular, carbides may be formed by using molybdenum, tungsten, chromium, titanium, niobium, vanadium, tantalum, zirconium, hafnium, manganese, iron, nickel, boron, and silicon in the material coating 328. Borides may be formed by using titanium, zirconium, hafnium, vanadium, niobium, tantalum, chromium, molybdenum, tungsten, iron, cobalt, nickel, and lanthanum in the material coating 328. Nitrides may be formed by using boron, silicon, aluminum, iron, nickel, scandium, yttrium, titanium, vanadium, chromium, zirconium, molybdenum, tungsten, tantalum, hafnium, manganese, and niobium in the material coating 328. Oxides may be formed by using silicon, aluminum, yttrium, zirconium, and titanium in the material coating 328.

Intermetallics may also prove advantageous since the formation of such materials in the outer shell 210 may produce beneficial changes in any of the desired properties mentioned previously. Suitable intermetallics include both stoichiometric and non-stoichiometric phases that are formed between two metallic elements. Examples of elements that form refractory aluminum-based intermetallics include boron, carbon, cobalt, chromium, copper, iron, hafnium, iridium, manganese, molybdenum, niobium, nickel, palladium, platinum, rhenium, ruthenium, scandium, tantalum, titanium, vanadium, tungsten, and zirconium. Other examples of refractory intermetallic systems include silver-titanium, silver-zirconium, gold-hafnium, gold-manganese, gold-niobium, gold-scandium, gold-tantalum, gold-titanium, gold-thulium, gold-vanadium, gold-zirconium, boron-chromium, boron-manganese, boron-molybdenum, boron-niobium, boron-neodymium, boron-ruthenium, boron-silicon, boron-titanium, boron-vanadium, boron-tungsten, boron-yttrium, beryllium-copper, beryllium-iron, beryllium-niobium, beryllium-nickel, beryllium-palladium, beryllium-titanium, beryllium-vanadium, beryllium-tungsten, beryllium-zirconium, any combination thereof, and the like.

In some embodiments, the material coating 328 may include and may otherwise be reinforced with reinforcing particles, such as the reinforcing particles mentioned above with reference to the reinforcing materials 318.

The material coating 328 may be directly deposited and otherwise placed on the interior of the mold assembly 300 using any known process. Suitable processes that may be employed include, but are not limited to, physical vapor deposition, chemical vapor deposition, sputtering, pulsed laser deposition, chemical solution deposition, plasma enhanced chemical vapor deposition, cathodic arc deposition, electrohydrodynamic deposition (i.e., electrospray deposition), ion-assisted electron-beam deposition, electrolytic plating, electroless plating, thermal evaporation, spin coating, dipping portions of the mold assembly 300 in a molten metal bath, and forming and placing foils. In some embodiments, the layer(s) of the material coating 328 may be formed under a controlled atmosphere such as high vacuum and/or inert atmosphere during the deposition process.

The layer(s) of the material coating 328 may exhibit a depth or thickness 330 ranging from about 25 microns to about 2500 microns. As will be appreciated, the thickness 330 of the material coating 328 may vary at selected locations on the interior of the mold assembly 300, and thereby result in thicker/thinner portions of the outer shell 210 applied to the outer surface(s) of the bit body 108 following infiltration. In some embodiments, the thickness 330 of the material coating 328 may vary about particular portions of the mold assembly 300, and thereby resulting in portions of the outer shell 210 that have a varying thickness.

As will be appreciated, the overall composition of the material coating 328, including the material, the number of layers deposited, and the type of reinforcing particles (if used), may be selected to serve different purposes in modifying the resulting surface properties of the drill bit 100 (or any MMC tool). In some embodiments, the material coating 328 may be deposited on the entire interior of the mold assembly 300 and, as indicated above, the exterior surfaces of one or more of the displacement members (e.g., the central displacement 316, the legs 314, the junk slot displacements 315, etc.), thereby modifying surface properties of all exterior portions of the bit body 108, including the backside (interior) of the pockets 116 and the interior surfaces of the fluid cavity 204*b*, flow passageways 206, and nozzle openings 122. In other embodiments, however, portions of the interior of the mold assembly 300 may alternatively be masked to selectively deposit the material coating 328 at desired locations while excluding the masked locations. In such embodiments, for example, portions of the mold assembly 300 may be masked to prevent the material coating 328 from being deposited in the pockets 116. This may prove advantageous when using some types of materials for the material coating 328 since the pockets 116 must be wettable in order to adequately braze the cutters 118 into the pockets 116.

In yet other embodiments, the material coating 328 may comprise various materials or material compositions deposited and otherwise included in different (selected) areas of the mold assembly 300 to serve different purposes. For instance, the material coating 328 deposited in the pockets 116 may comprise a particular material composition that is wettable by the braze material used to braze the cutters 118 into the pockets 116. Suitable examples include reactive metals, such as titanium, chromium, vanadium, niobium, zirconium, and hafnium. However, the material coating 328 deposited around and otherwise outside of the pockets 116 may comprise a different material composition that may result in a wear-resistant, erosion-resistant, abrasion-resistant, or hard metallic composition. Suitable examples of materials that may result in a wear-resistant, erosion-resistant, abrasion-resistant, or hard metallic composition include, but are not limited to, alloys that contain chromium, carbon, molybdenum, manganese, nickel, cobalt, tungsten, niobium, tantalum, vanadium, silicon, copper, and iron.

As another example, the material coating 328 deposited around and otherwise outside of the pockets 116 may comprise a different material composition that may result in a stiffer metallic composition. Suitable examples of materials that may result in a stiffer metallic composition include, but are not limited to, alloys that contain nickel, vanadium, chromium, molybdenum, tantalum, tungsten, rhenium, osmium, and iridium. As yet another example, the material coating 328 deposited in the junk slots 124 (e.g., on junk-slot displacements 315), the central displacement 316, and the legs 314 may comprise a hydrophobic material composition that will help mitigate bit-balling in the junk slots 124 during operation. Suitable examples of materials that may result in mitigating bit-balling include ceramic materials, such as the carbides, borides, nitrides, and oxides listed above.

In some embodiments, two or more layers of the material coating 328 may be applied and/or deposited on the cutter blades 102 to help erosion resistance and reduce friction. For example, a layer of nickel (or a nickel alloy) may be deposited on the cutter blades 102 and a layer of aluminum may subsequently be deposited atop the layer nickel, thereby providing a material coating 328 that results in an intermetallic outer shell 210 composition of nickel and aluminum following infiltration. Such layering may prove advantageous in encapsulating the aluminum layer between the nickel material and the reinforcing materials 318, thereby substantially mitigating oxidation of the aluminum during the infiltration process. Similar benefits may be gained with materials that are volatile (e.g., elements that have low sublimation and boiling points) or active and that are prone to oxidation. Examples of elements that would benefit from a protective layer include titanium, zinc, magnesium, silicon, chromium, manganese, scandium, yttrium, niobium, carbon, nitrogen, boron, oxygen. In such embodiments, the volatile materials may be encapsulated by one or more layers of another material, thereby substantially preventing the volatile material from vaporizing, sublimating, or oxidizing during the infiltration process.

In some embodiments, the material coating 328 may comprise a three-layer symmetric configuration wherein a protective layer is disposed on both sides (i.e., inner and outer extremities) of the material coating 328. In such embodiments, suitable materials used to make the material coating 328 include a layer of aluminum interposing opposing layers of nickel. More particularly, the material coating 328 may be formed by depositing a first layer of nickel, followed by a layer of aluminum, which is then followed by a second layer of nickel. As a result, the aluminum material may be encapsulated between the two nickel layers. Additional embodiments may involve the use of other oxidation-resistant metals, such as silver or copper, to protect oxidation-prone metals, such as titanium, magnesium, or zirconium, in the inner layer from oxidizing.

In some embodiments, the material coating 328 may comprise a two- or three-layer configuration where the inner layer (i.e., the layer that will interact with the binder material 324 during infiltration) is thicker than the other layers and/or of a composition that prevents significant interaction between the outer shell 210 (FIG. 2) formed in-situ and the resulting MMC tool 100. In such embodiments, the inner layer works to bond the outer shell 210 to the bit body 108 (FIGS. 1 and 2) while also preventing significant interaction between the two dissimilar materials. Examples can include a copper inner layer, a nickel outer layer, and an aluminum layer interposing the copper and nickel layers, where the copper layer is about 5 to 20 times thicker than the nickel layer. Other examples include: a copper inner layer, a titanium outer layer, and an aluminum layer interposing the copper and titanium layers; a vanadium inner layer, a nickel outer layer, and an aluminum layer interposing the vanadium and nickel layers; a vanadium inner layer, a titanium outer layer, and an aluminum layer interposing the vanadium and titanium layers; a tungsten inner layer, a nickel outer layer, and an aluminum layer interposing the tungsten and nickel layers; and a tungsten inner layer, a titanium outer layer, and an aluminum layer interposing the tungsten and titanium layers.

Additional examples include a refractory inner layer with at least two outer layers composed of materials that may form an intermetallic or ceramic compound with each other. Suitable refractory-layer materials include transition metals such as tungsten, rhenium, osmium, tantalum, molybdenum, niobium, iridium, ruthenium, hafnium, and alloys thereof. Suitable intermetallic- or ceramic-forming materials include those listed herein and any alloys thereof. Yet other examples include a thick compliant inner layer with at least two outer layers composed of materials that may form an intermetallic or ceramic compound with each other. Suitable compliant-layer materials include transition metals such as copper, palladium, niobium, silver, gold, hafnium, zirconium, and alloys thereof. Again, suitable intermetallic- or ceramic-forming materials include those listed herein and any alloys thereof.

In some embodiments, the material coating 328 may comprise a three-layer configuration where the material of the center layer comprises a reinforcement material such that the inner and outer layers will encapsulate the reinforcement particles on melting and/or being infiltrated by or diffused into with the infiltrating binder material 324. In such embodiments, suitable material configurations include: a nickel inner layer, a nickel outer layer, and a tungsten carbide layer interposing the nickel layers; and a copper inner layer, a nickel outer layer, and a tungsten carbide layer interposing the copper and nickel layers. Additional examples include transition metals as the inner and outer layers and a reinforcing material as the interposed layer. Suitable materials for the inner and outer layers include transition metals, such as copper, palladium, niobium, silver, gold, hafnium, zirconium, tungsten, rhenium, osmium, tantalum, molybdenum, niobium, iridium, ruthenium, hafnium, and alloys thereof. Suitable materials for the interposed reinforcing layer include any of the materials listed herein as suitable for the reinforcement materials 328 of FIG. 3.

Figure 4:
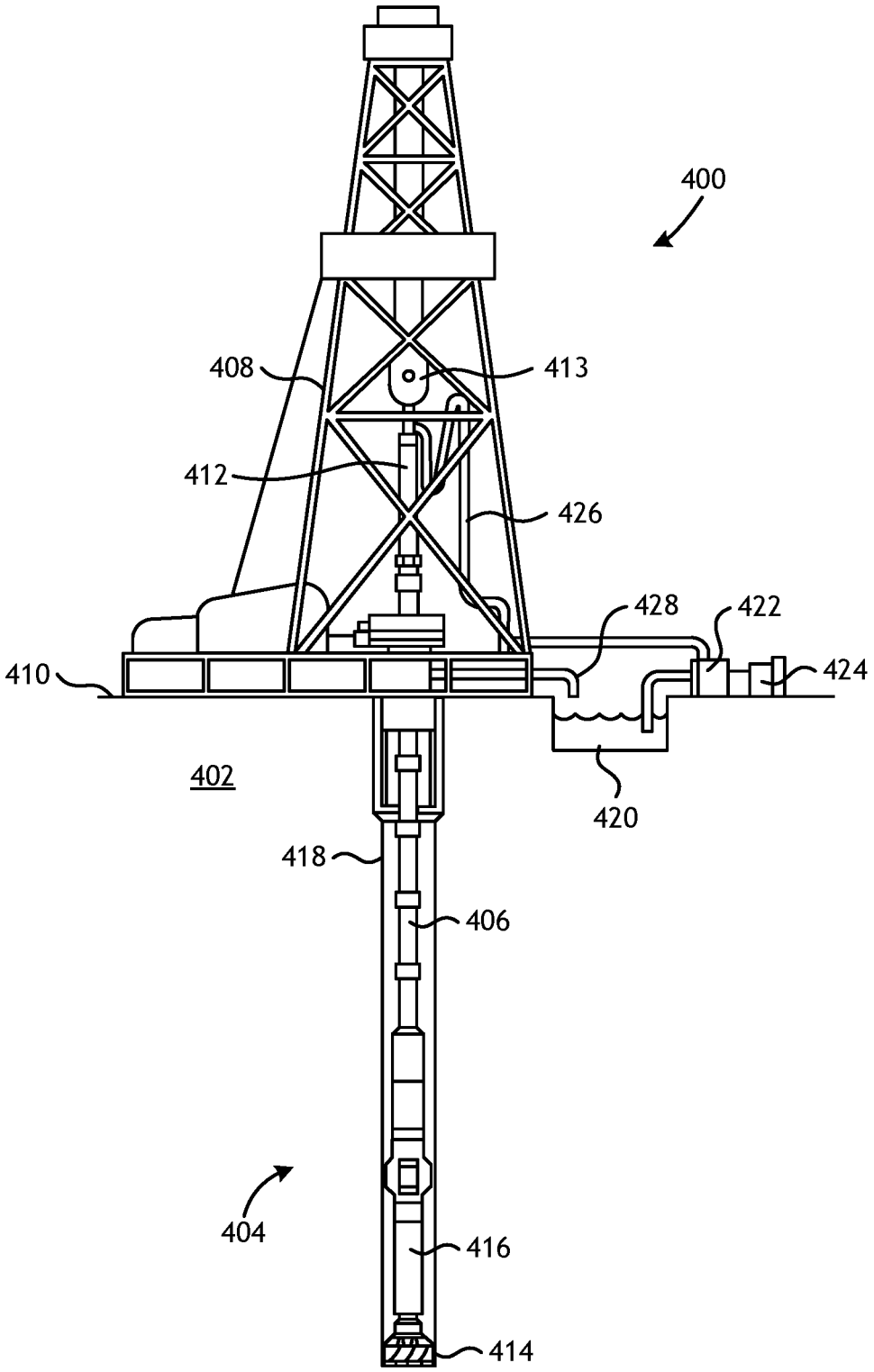
FIG. 4 is an exemplary drilling system that may employ one or more principles of the present disclosure.

Referring now to FIG. 4, illustrated is an exemplary drilling system 400 that may employ one or more principles of the present disclosure. Boreholes may be created by drilling into the earth 402 using the drilling system 400. The drilling system 400 may be configured to drive a bottom hole assembly (BHA) 404 positioned or otherwise arranged at the bottom of a drill string 406 extended into the earth 402 from a derrick 408 arranged at the surface 410. The derrick 408 includes a kelly 412 and a traveling block 413 used to lower and raise the kelly 412 and the drill string 406.

The BHA 404 may include a drill bit 414 operatively coupled to a tool string 416 which may be moved axially within a drilled wellbore 418 as attached to the drill string 406. The drill bit 414 may be fabricated and otherwise created in accordance with the principles of the present disclosure and, more particularly, with mesoscale reinforcing structures. During operation, the drill bit 414 penetrates the earth 402 and thereby creates the wellbore 118. The BHA 404 provides directional control of the drill bit 414 as it advances into the earth 402. The tool string 416 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 416, as shown in FIG. 4.

Fluid or "mud" from a mud tank 420 may be pumped downhole using a mud pump 422 powered by an adjacent power source, such as a prime mover or motor 424. The mud may be pumped from the mud tank 420, through a stand pipe 426, which feeds the mud into the drill string 406 and conveys the same to the drill bit 414. The mud exits one or more nozzles arranged in the drill bit 414 and in the process cools the drill bit 414. After exiting the drill bit 414, the mud circulates back to the surface 410 via the annulus defined between the wellbore 418 and the drill string 106, and in the process returns drill cuttings and debris to the surface. The cuttings and mud mixture are passed through a flow line 428 and are processed such that a cleaned mud is returned down hole through the stand pipe 426 once again.

Although the drilling system 400 is shown and described with respect to a rotary drill system in FIG. 4, those skilled in the art will readily appreciate that many types of drilling systems can be employed in carrying out embodiments of the disclosure. For instance, drills and drill rigs used in embodiments of the disclosure may be used onshore (as depicted in FIG. 1) or offshore (not shown). Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

Embodiments disclosed herein include:

A. A method of fabricating a metal matrix composite (MMC) tool that includes coating at least a portion of an interior of a mold assembly with one or more layers of a material coating, the mold assembly defining at least a portion of an infiltration chamber, depositing reinforcing materials into the infiltration chamber, infiltrating the reinforcing materials with a binder material, and reacting at least one of the one or more layers of the material coating with the binder material and thereby forming an outer shell on selected outer surfaces of the MMC tool B. A drill bit that includes a bit body comprising a reinforced composite material made by infiltrating reinforcement materials with a binder material, a plurality of cutting elements coupled to an exterior of the bit body, and an outer shell disposed on selected outer surfaces of the bit body, the outer shell being made from one or more layers of a material coating deposited on at least a portion of an interior of a mold assembly used to fabricate the drill bit, wherein the outer shell results from at least one of the one or more layers of the material coating reacting with the binder material during infiltration.

C. A drilling assembly that includes a drill string extendable from a drilling platform and into a wellbore, a drill bit attached to an end of the drill string, and a pump fluidly connected to the drill string and configured to circulate a drilling fluid to the drill bit and through the wellbore, wherein the drill bit comprises a bit body comprising a reinforced composite material made by infiltrating reinforcement materials with a binder material, a plurality of cutting elements coupled to an exterior of the bit body, and an outer shell disposed on selected outer surfaces of the bit body, the outer shell being made from one or more layers of a material coating deposited on at least a portion of an interior of a mold assembly used to fabricate the drill bit, wherein the outer shell results from at least one of the one or more layers of the material coating reacting with the binder material during infiltration.

Each of embodiments A, B, and C may have one or more of the following additional elements in any combination: Element 1: wherein the MMC tool is a tool selected from the group consisting of oilfield drill bits or cutting tools, non-retrievable drilling components, aluminum drill bit bodies associated with casing drilling of wellbores, drill-string stabilizers, a cone for roller-cone drill bits, a model for forging dies used to fabricate support arms for roller-cone drill bits, an arm for fixed reamers, an arm for expandable reamers, an internal component associated with expandable reamers, a sleeve attachable to an uphole end of a rotary drill bit, a rotary steering tool, a logging-while-drilling tool, a measurement-while-drilling tool, a side-wall coring tool, a fishing spear, a washover tool, a rotor, a stator and/or housing for downhole drilling motors, blades for downhole turbines, and any combination thereof. Element 2: wherein the one or more layers of the material coating further comprise reinforcing particles selected from the group consisting of a metal, a metal alloy, a superalloy, an intermetallic, a boride, a carbide, a nitride, an oxide, a ceramic, a diamond, and any combination thereof. Element 3: wherein the MMC tool is a drill bit and the mold assembly includes one or more of a mold, a gauge ring, and a funnel, and wherein coating at least the portion of the interior of the mold assembly comprises coating an inner wall of one or more of the mold and the gauge ring with the one or more layers of the material coating. Element 4: wherein the mold assembly includes at least one flow passageway, and wherein coating at least the portion of the interior of the mold assembly further comprises coating an exterior surface of the at least one flow passageway. Element 5: further comprising modifying outer surface material properties of the MMC tool with the one or more layers of the material coating, the outer surface material properties being selected from the group consisting of wear resistance, erosion resistance, abrasion resistance, stiffness, hardness, yield strength, ultimate tensile strength, fatigue life, lubricity, hydrophobicity, anti-balling characteristics, surface roughness, and surface energy. Element 6: wherein the one or more layers of the material coating comprise a material selected from the group consisting of a transition metal, a post-transition metal, a semi-metal, an alkaline-earth metal, a lanthanide, a non-metal, and any alloy thereof. Element 7: wherein reacting at least one of the one or more layers of the material coating with the binder material comprises at least one of alloying with, diffusing into, and inter-diffusing with and thereby forming at least one of an alloy, an intermetallic, and a ceramic in-situ. Element 8: wherein the one or more layers of the material coating includes at least a first layer and a second layer, the method further comprising reacting the first layer with the second layer by at least one of alloying with, diffusing into, and inter-diffusing with and thereby forming at least one of an alloy, an intermetallic, and a ceramic in-situ. Element 9: wherein coating at least the portion of the interior of the mold assembly with the one or more layers of the material coating comprises depositing the one or more layers of the material coating with a process selected from the group consisting of physical vapor deposition, chemical vapor deposition, sputtering, pulsed laser deposition, chemical solution deposition, plasma enhanced chemical vapor deposition, cathodic arc deposition, electrohydrodynamic deposition, ion-assisted electron-beam deposition, electrolytic plating, electroless plating, thermal evaporation, spin coating, dipping the portion of the interior of the mold assembly in a molten metal bath, and forming and placing foils. Element 10: further comprising masking the interior of the mold assembly to selectively deposit the one or more layers of the material coating at desired locations on inner surfaces of the mold assembly. Element 11: further comprising varying a thickness of the one or more layers of the material coating at desired locations on inner surfaces of the mold assembly.

Element 12: wherein the one or more layers of the material coating further comprise reinforcing particles selected from the group consisting of a metal, a metal alloy, a superalloy, an intermetallic, a boride, a carbide, a nitride, an oxide, a ceramic, a diamond, and any combination thereof. Element 13: wherein the mold assembly includes one or more of a mold, a gauge ring, and a funnel, and wherein an inner wall of one or more of the mold and the gauge ring is coated with the one or more layers of the material coating to produce the outer shell. Element 14: wherein the mold assembly further includes at least one flow passageway, and wherein an exterior surface of at least one of the fluid cavity and the at least one flow passageway is coated with the one or more layers of the material coating to produce the outer shell. Element 15: wherein the one or more layers of the material coating modify outer surface material properties of the drill bit selected from the group consisting of wear resistance, erosion resistance, abrasion resistance, stiffness, hardness, yield strength, ultimate tensile strength, fatigue life, lubricity, hydrophobicity, anti-balling characteristics, surface roughness, and surface energy. Element 16: wherein the one or more layers of the material coating comprise a material selected from the group consisting of a transition metal, a post-transition metal, a semi-metal, an alkaline-earth metal, a lanthanide, a non-metal, and any alloy thereof. Element 17: wherein reacting at least one of the one or more layers of the material coating with the binder material comprises at least one of alloying with, diffusing into, and inter-diffusing with and thereby forming at least one of an alloy, an intermetallic, and a ceramic in-situ. Element 18: wherein the one or more layers of the material coating includes at least a first layer and a second layer, the method further comprising reacting the first layer with the second layer by at least one of alloying with, diffusing into, and inter-diffusing with and thereby forming at least one of an alloy, an intermetallic, and a ceramic in-situ. Element 19: wherein the one or more layers of the material coating are deposited on the interior of the mold assembly using a process selected from the group consisting of physical vapor deposition, chemical vapor deposition, sputtering, pulsed laser deposition, chemical solution deposition, plasma enhanced chemical vapor deposition, cathodic arc deposition, electrohydrodynamic deposition, ion-assisted electron-beam deposition, electrolytic plating, electroless plating, thermal evaporation, spin coating, dipping the portion of the interior of the mold assembly in a molten metal bath, and forming and placing foils. Element 20: wherein the interior of the mold assembly is masked to selectively deposit the one or more layers of the material coating at desired locations on inner surfaces of the mold assembly.

Element 21: wherein the one or more layers of the material coating further comprise reinforcing particles selected from the group consisting of a metal, a metal alloy, a superalloy, an intermetallic, a boride, a carbide, a nitride, an oxide, a ceramic, a diamond, and any combination thereof. Element 22: wherein the one or more layers of the material coating comprise a material selected from the group consisting of a transition metal, a post-transition metal, a semi-metal, an alkaline-earth metal, a lanthanide, a non-metal, and any alloy thereof.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from a to b," "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed:

1. A method of fabricating a metal matrix composite (MMC) tool, comprising:

coating at least a portion of an interior of a mold assembly with one or more layers of a material coating, the mold assembly defining at least a portion of an infiltration chamber;

depositing reinforcing materials into the infiltration chamber;

infiltrating the reinforcing materials with a binder material to form the MMC tool; and reacting at least one of the one or more layers of the material coating with the binder material and thereby forming an outer shell on selected outer surfaces of the MMC tool during infiltration, wherein reacting at least one of the one or more layers of the material coating with the binder material comprises at least one of alloying with, undergoing a chemical reaction, diffusing into, and inter-diffusing with and thereby forming at least one of an alloy, an intermetallic, and a ceramic in-situ.

2. The method of claim 1, wherein the MMC tool is a tool selected from the group consisting of oilfield drill bits or cutting tools, non-retrievable drilling components, aluminum drill bit bodies associated with casing drilling of wellbores, drill-string stabilizers, a cone for roller-cone drill bits, a model for forging dies used to fabricate support arms for roller-cone drill bits, an arm for fixed reamers, an arm for expandable reamers, an internal component associated with expandable reamers, a sleeve attachable to an uphole end of a rotary drill bit, a rotary steering tool, a logging-while-drilling tool, a measurement-while-drilling tool, a side-wall coring tool, a fishing spear, a washover tool, a rotor, a stator and/or housing for downhole drilling motors, blades for downhole turbines, and any combination thereof.

3. The method of claim 1, wherein the one or more layers of the material coating further comprise reinforcing particles selected from the group consisting of a metal, a metal alloy, a superalloy, an intermetallic, a boride, a carbide, a nitride, an oxide, a ceramic, a diamond, and any combination thereof.

4. The method of claim 1, wherein the MMC tool is a drill bit and the mold assembly includes one or more of a mold, a gauge ring, and a funnel, and wherein coating at least the portion of the interior of the mold assembly comprises coating an inner wall of one or more of the mold and the gauge ring with the one or more layers of the material coating.

5. The method of claim 1, wherein the mold assembly includes at least one flow passageway, and wherein coating at least the portion of the interior of the mold assembly further comprises coating an exterior surface of the at least one flow passageway.

6. The method of claim 1, further comprising modifying outer surface material properties of the MMC tool with the one or more layers of the material coating, the outer surface material properties being selected from the group consisting of wear resistance, erosion resistance, abrasion resistance, stiffness, hardness, yield strength, ultimate tensile strength, fatigue life, lubricity, hydrophobicity, anti-balling characteristics, surface roughness, and surface energy.

7. The method of claim 1, wherein the one or more layers of the material coating comprise a material selected from the group consisting of a transition metal, a post-transition metal, a semi-metal, an alkaline-earth metal, a lanthanide, a non-metal, and any alloy thereof.

8. The method of claim 1, wherein the one or more layers of the material coating includes at least a first layer and a second layer, wherein the first layer and the second layer react together thereby forming at least one of an alloy, an intermetallic, and a ceramic in-situ.

9. The method of claim 1, wherein coating at least the portion of the interior of the mold assembly with the one or more layers of the material coating comprises depositing the one or more layers of the material coating with a process selected from the group consisting of physical vapor deposition, chemical vapor deposition, sputtering, pulsed laser deposition, chemical solution deposition, plasma enhanced chemical vapor deposition, cathodic arc deposition, electrohydrodynamic deposition, ion-assisted electron-beam deposition, electrolytic plating, electroless plating, thermal evaporation, spin coating, dipping the portion of the interior of the mold assembly in a molten metal bath, and forming and placing foils.

10. The method of claim 1, further comprising masking the interior of the mold assembly to selectively deposit the one or more layers of the material coating at desired locations on inner surfaces of the mold assembly.

11. The method of claim 1, further comprising varying a thickness of the one or more layers of the material coating at desired locations on inner surfaces of the mold assembly.

12. A drill bit, comprising:

a bit body comprising a reinforced composite material made by infiltrating reinforcement materials with a binder material;

a plurality of cutting elements coupled to an exterior of the bit body; and an outer shell disposed on selected outer surfaces of the bit body, the outer shell being made from one or more layers of a material coating deposited on at least a portion of an interior of a mold assembly used to fabricate the drill bit, wherein the outer shell results from at least one of the one or more layers of the material coating reacting with the binder material during infiltration, wherein reacting the at least one of the one or more layers of the material coating with the binder material comprises at least one of alloying with, undergoing a chemical reaction, diffusing into, and inter-diffusing with and thereby forming at least one of an alloy, an intermetallic, and a ceramic in-situ.

13. The drill bit of claim 12, wherein the one or more layers of the material coating further comprise reinforcing particles selected from the group consisting of a metal, a metal alloy, a superalloy, an intermetallic, a boride, a carbide, a nitride, an oxide, a ceramic, a diamond, and any combination thereof.

14. The drill bit of claim 12, wherein the mold assembly includes one or more of a mold, a gauge ring, and a funnel, and wherein an inner wall of one or more of the mold and the gauge ring is coated with the one or more layers of the material coating to produce the outer shell.

15. The drill bit of claim 12, wherein the mold assembly further includes at least one flow passageway, and wherein an exterior surface of at least one fluid cavity and the at least one flow passageway is coated with the one or more layers of the material coating to produce the outer shell.

16. The drill bit of claim 12, wherein the one or more layers of the material coating modify outer surface material properties of the drill bit selected from the group consisting of wear resistance, erosion resistance, abrasion resistance, stiffness, hardness, yield strength, ultimate tensile strength, fatigue life, lubricity, hydrophobicity, anti-balling characteristics, surface roughness, and surface energy.

17. The drill bit of claim 12, wherein the one or more layers of the material coating comprise a material selected from the group consisting of a transition metal, a post-transition metal, a semi-metal, an alkaline-earth metal, a lanthanide, a non-metal, and any alloy thereof.

18. The drill bit of claim 12, wherein the one or more layers of the material coating includes at least a first layer and a second layer, wherein the first layer and the second layer react together thereby forming at least one of an alloy, an intermetallic, and a ceramic in-situ.

19. The drill bit of claim 12, wherein the one or more layers of the material coating are deposited on the interior of the mold assembly using a process selected from the group consisting of physical vapor deposition, chemical vapor deposition, sputtering, pulsed laser deposition, chemical solution deposition, plasma enhanced chemical vapor deposition, cathodic arc deposition, electrohydrodynamic deposition, ion-assisted electron-beam deposition, electrolytic plating, electroless plating, thermal evaporation, spin coating, dipping the portion of the interior of the mold assembly in a molten metal bath, and fanning and placing foils.

20. The drill bit of claim 12, wherein the interior of the mold assembly is masked to selectively deposit the one or more layers of the material coating at desired locations on inner surfaces of the mold assembly.

21. A drilling assembly, comprising:

a drill string extendable from a drilling platform and into a wellbore;

a drill bit attached to an end of the drill string; and a pump fluidly connected to the drill string and configured to circulate a drilling fluid to the drill bit and through the wellbore, wherein the drill bit comprises:

a bit body comprising a reinforced composite material made by infiltrating reinforcement materials with a binder material;

a plurality of cutting elements coupled to an exterior of the bit body; and an outer shell disposed on selected outer surfaces of the bit body, the outer shell being made from one or more layers of a material coating deposited on at least a portion of an interior of a mold assembly used to fabricate the drill bit, wherein the outer shell results from at least one of the one or more layers of the material coating reacting with the binder material during infiltration, wherein reacting the at least one of the one or more layers of the material coating with the binder material comprises at least one of alloying with, undergoing a chemical reaction, diffusing into, and inter-diffusing with and thereby forming at least one of an alloy, an intermetallic, and a ceramic in-situ.

22. The drilling assembly of claim 21, wherein the one or more layers of the material coating further comprise reinforcing particles selected from the group consisting of a metal, a metal alloy, a superalloy, an intermetallic, a boride, a carbide, a nitride, an oxide, a ceramic, a diamond, and any combination thereof.

23. The drilling assembly of claim 21, wherein the one or more layers of the material coating comprise a material selected from the group consisting of a transition metal, a post-transition metal, a semi-metal, an alkaline-earth metal, a lanthanide, a non-metal, and any alloy thereof.

* * * * *